US005525765A

United States Patent [19]

Freiheit

[11] Patent Number: 5,525,765

[45] Date of Patent: Jun. 11, 1996

[54] ACOUSTICAL VIRTUAL ENVIRONMENT

[75] Inventor: Ronald R. Freiheit, Owatonna, Minn.

[73] Assignee: Wenger Corporation, Owatonna, Minn.

[21] Appl. No.: 254,300

[22] Filed: Jun. 6, 1994

Related U.S. Application Data

[63] Continuation-in-part of Ser. No. 118,057, Sep. 8, 1993, abandoned.

[51] Int. Cl.[6] ..... E04B 1/99

[52] U.S. Cl. ..... 181/30

[58] Field of Search ..... 181/30, 144, 150, 181/286, 295

[56] References Cited

U.S. PATENT DOCUMENTS 4,330,691 5/1982 Gordon ..... 181/144

4,366,882 2/1983 Parker ..... 181/30

*Primary Examiner*—Khanh Dang

*Attorney, Agent, or Firm*—Patterson & Keough

[57] ABSTRACT

A rehearsal room especially adapted to produce the auralization effect of different acoustical environments. The rehearsal room broadly includes a performance space defined by a plurality of walls, each of the walls including a plurality of acoustical absorption panels, a floor and a ceiling, a plurality of microphones operably coupled to the ceiling at predetermined locations, a plurality of acoustical speakers operably coupled to the ceiling at predetermined locations relative to the position of the microphones and speakers; and an electroacoustic system connected to the microphones and speakers for recording, broadcasting and simulating sound.

21 Claims, 7 Drawing Sheets

ACOUSTICAL VIRTUAL ENVIRONMENT

This is a continuation-in-part of application Ser. No. 08/118,057, filed Sep. 8, 1993, now abandoned.

TECHNICAL FIELD

The present invention deals broadly with the field of musical and speech rehearsal and recording areas. More specifically, it relates to a rehearsal room especially adapted to present varying acoustical environments.

BACKGROUND OF THE INVENTION

Musicians and speech givers spend many hours rehearsing their pieces. In the past, this practice occurred in small acoustically isolated rehearsal areas which allowed the performer the opportunity to hear themselves clearly. In conventional rehearsal rooms, the rehearsal room is constructed of sound blocking materials to isolate the rehearsal area from the external sounds of the surrounding areas. Within the room, reverberations of the sounds generated by the performer are frequently absorbed by the room walls, floor and/or ceiling to prevent the reverberations of the performance from overwhelming the performer.

In contrast to a small rehearsal room, the reverberations of a performance hall or auditorium echo through the larger space of the performance hall creating a very different acoustical environment. A performance hall typically includes space dedicated to holding an audience while a conventional rehearsal room does not. It is the differences in the direction of the reverberations, sound intensity and time lag of the reverberations through the differing volumes of physical space which create the acoustical environment of a room. For the performer, the difference in the acoustical environments between a small rehearsal room and large performance hall can hinder performances.

Frequently the performer does not have access to the performance hall or may not have access for a sufficient amount of time to become accustomed to the acoustical environment of the performance hall. In conventional rehearsal rooms, the dimensions and construction materials of the room cannot be easily changed to alter the acoustical environment to simulate a performance environment.

With the advent of electronics, electroacoustic systems using microphones, speakers and other electronic devices can enhance the acoustical environment of large performance halls to solve acoustical problems, such as inadequate reverberation time or level, insufficient lateral energy or excessive time delay, stemming from the basic problems of speaker placement, microphone placement, and acoustic feedback in the large hall. Unfortunately, many of these systems are expensive, use complex designs that are not easily changed or incorporated in small rehearsal rooms and may require a dedicated operator to use.

In addition, these systems are not readily adaptable to placement in a small physical area such as a rehearsal or practice room because they are not designed to compensate for the strong sound coloration and acoustic feedback in a small enclosed space. In a small enclosed space, sound waves bounce off the walls and swirl back on themselves even as new sound waves are produced. It is difficult to isolate and capture the desired sound waves from the reverberating waves in a small enclosed space.

Home entertainment systems which try to simulate the listening environment of a larger auditorium in a home encounter the same problems of sound coloration and acoustic feedback as well as the problem of distinguishable echoes emanating from individual speakers as the listener moves around the room.

A rehearsal room which provides an acoustically isolated practice area and is readily adaptable to simulate a variety of acoustical environments during a performance would be greatly appreciated.

SUMMARY OF THE INVENTION

The present invention provides an acoustically isolated practice area which can provide an auralization effect approximating that of the auralization effect of a large performance hall.

A rehearsal room in accordance with the present invention broadly includes a performance space defined by a plurality of walls, each of the walls including a plurality of acoustical absorption panels, a floor and a ceiling, a plurality of microphones operably coupled to the ceiling or walls at predetermined locations, a plurality of acoustical speakers operably coupled to the ceiling, walls or floor at predetermined locations relative to the position of the microphones and speakers; and an electroacoustical system connected to the microphones and speakers for recording, broadcasting and simulating sound. The present invention enhances sound performances in the performance space to simulate physical environments with different acoustical characteristics.

DETAILED DESCRIPTION OF THE INVENTION

Figure 1:
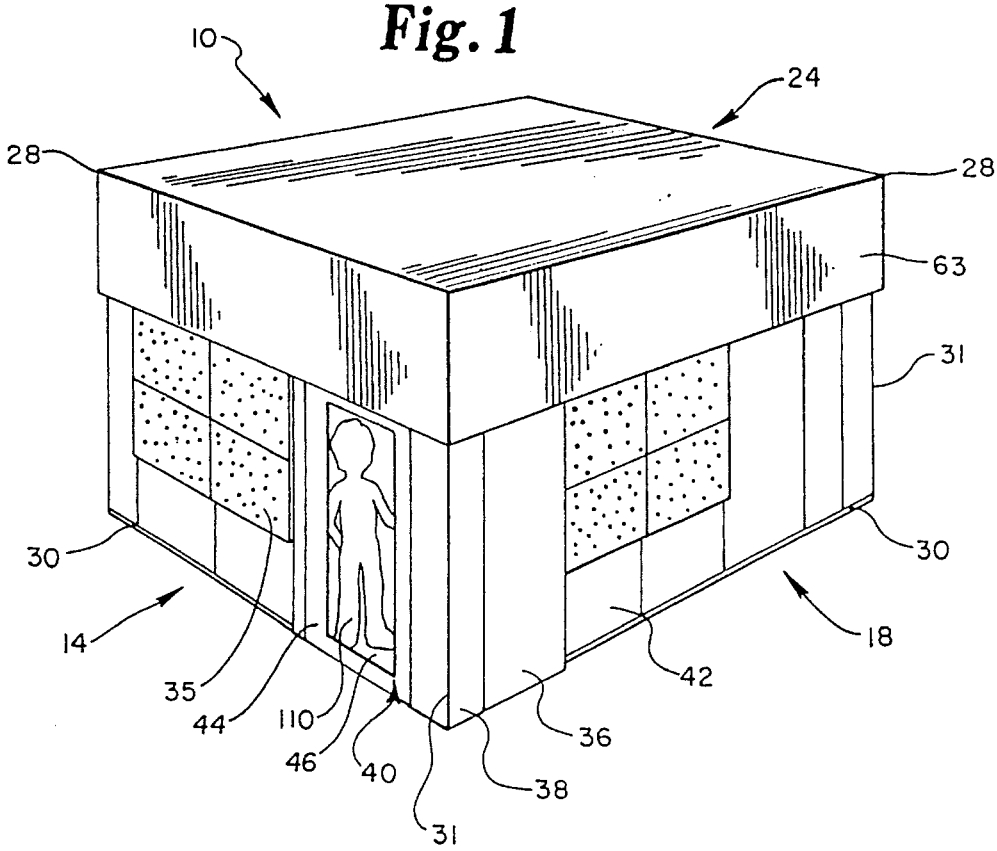
FIG. 1 is a perspective view of the acoustic performance module in accordance with the present invention.
Figure 2:
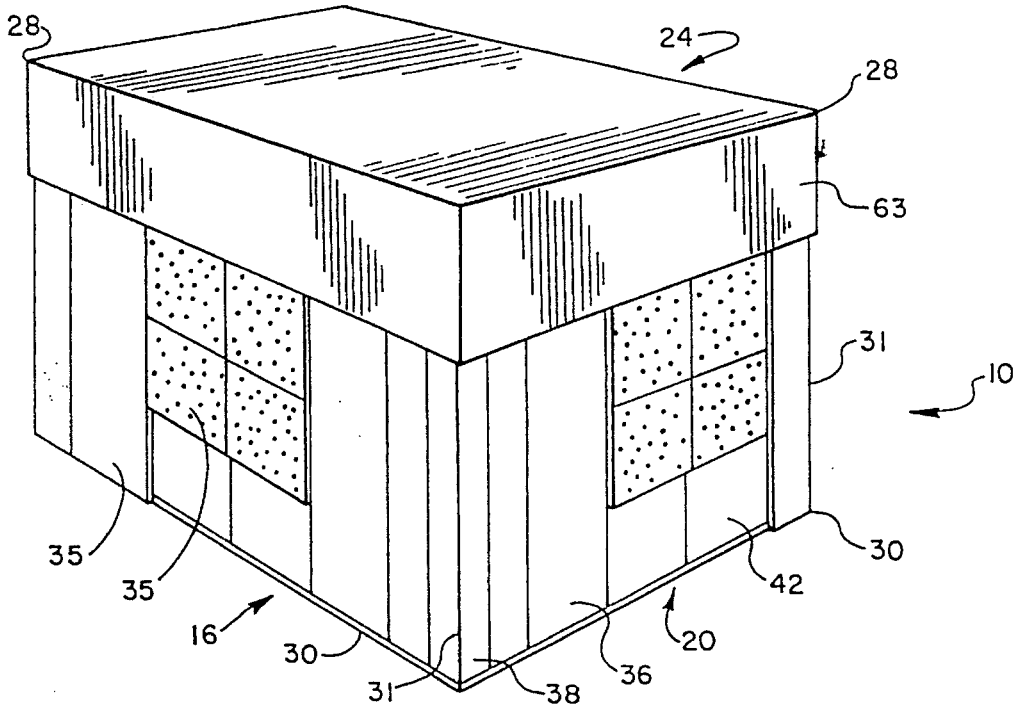
FIG. 2 is a rear perspective view of the acoustic performance module with the ceiling removed for clarity.
Figure 3:
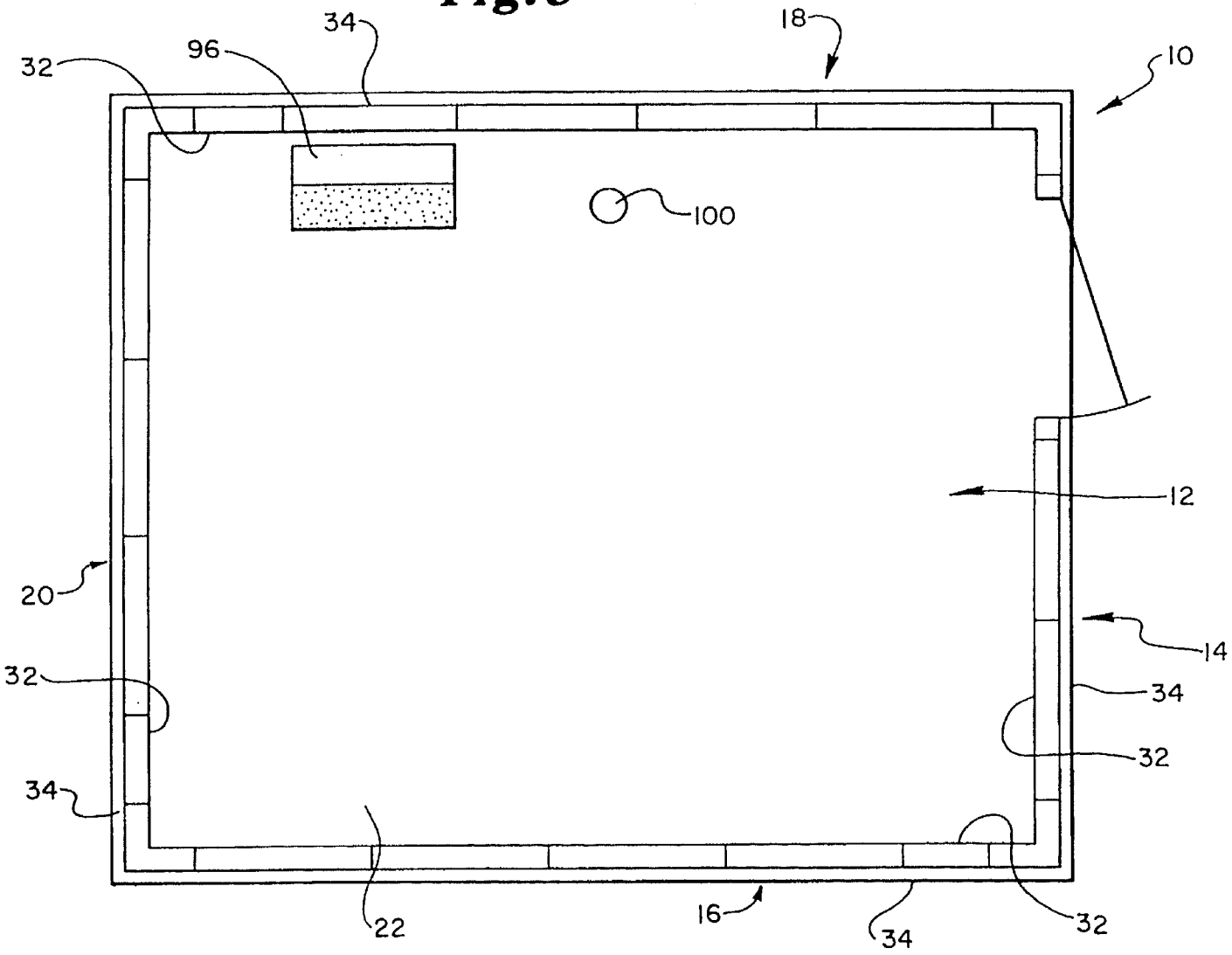
FIG. 3 is a top plan view of the acoustic performance module.

Referring now to the drawings, wherein like reference numerals denote like elements throughout the several views, an acoustic performance module 10, as illustrated in FIGS. 1, 2 and 3, broadly includes a performing space 12 defined by front wall 14, opposed side walls 16, 18, rear wall 20, floor 22 and ceiling 24, and electroacoustic system 26.

Each of walls 14, 16, 18, 20 carries an upper wall margin 28, lower wall margin 30, opposed side margins 31, inner surface 32 and outer surface 34. Each of the walls 14, 16, 18, 20 presents a characteristic height of at least seven and a half feet.

Referring to FIGS. 1 and 2, the outer surface 34 of each of the walls 14, 16, 18, 20 may include one or more facades 35. The facades 35 may vary in construction and material and provide an aesthetically pleasing look to the outer surface 34 of the walls 14, 16, 18, 20.

The inner surface 32 of each of the walls 14, 16, 18, 20 includes a plurality of vertical modular panels 36, 38, 40, 42 of substantially uniform height but which may vary in width and construction. For example, modular panel 38 presents relatively narrow characteristic width in comparison to modular panel 36. Modular panel 40 includes a swinging door 44 with glass panel 46. Modular panel 42 includes perforated inner liners 48 housing one or more sound absorption panels 50.

Figure 4:
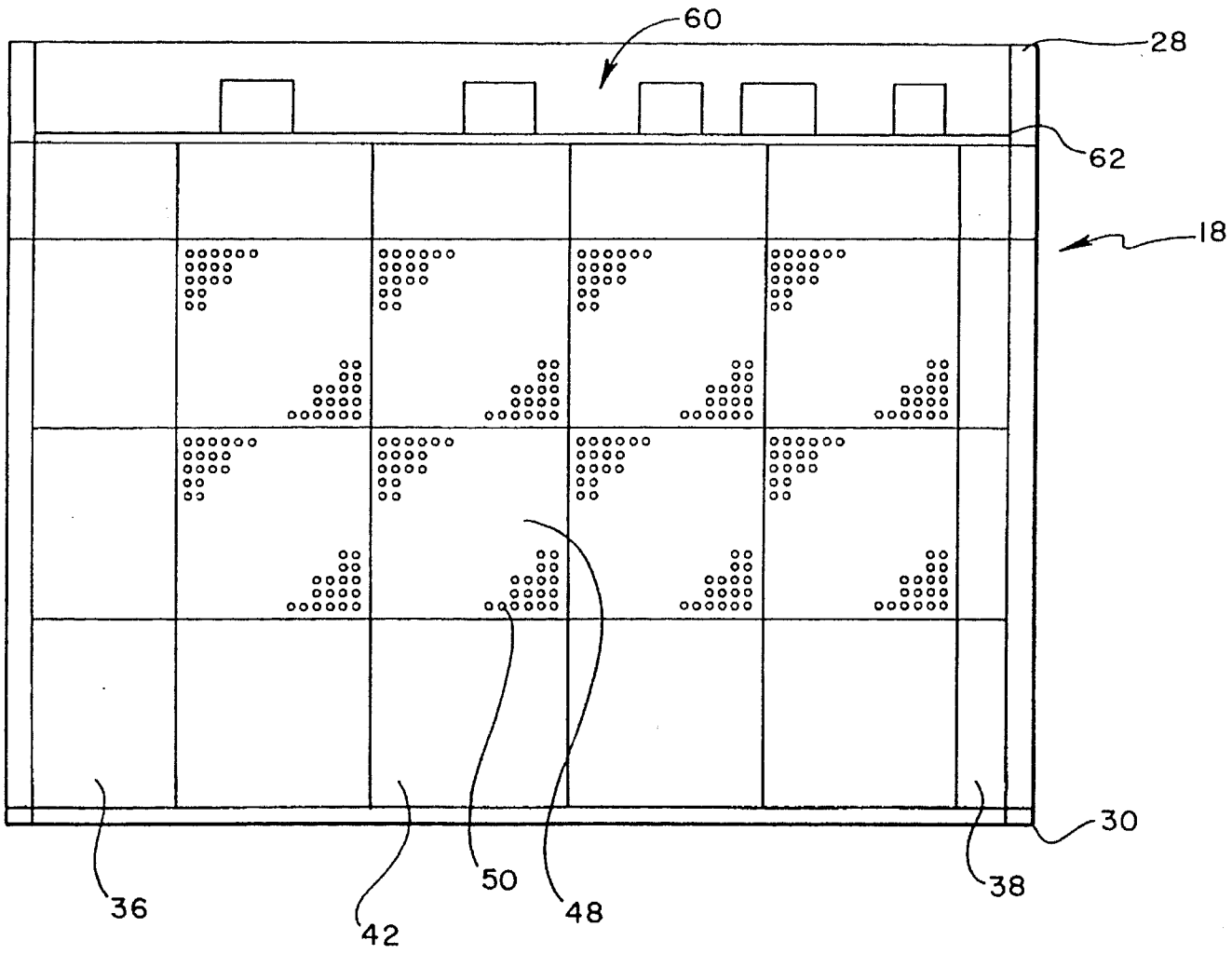
FIG. 4 is an elevational view of the inner surface of side walls of the acoustic performance module.
Figure 5:
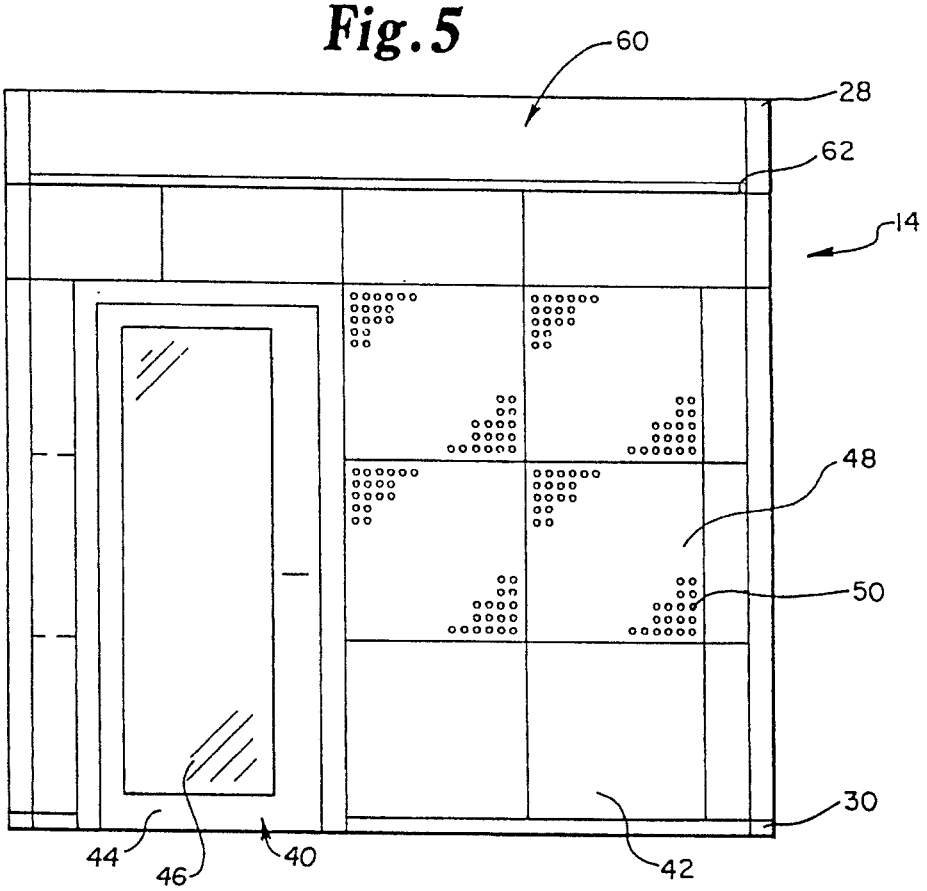
FIG. 5 is an elevational view of inner surface of front wall of the acoustic performance module.
Figure 6:
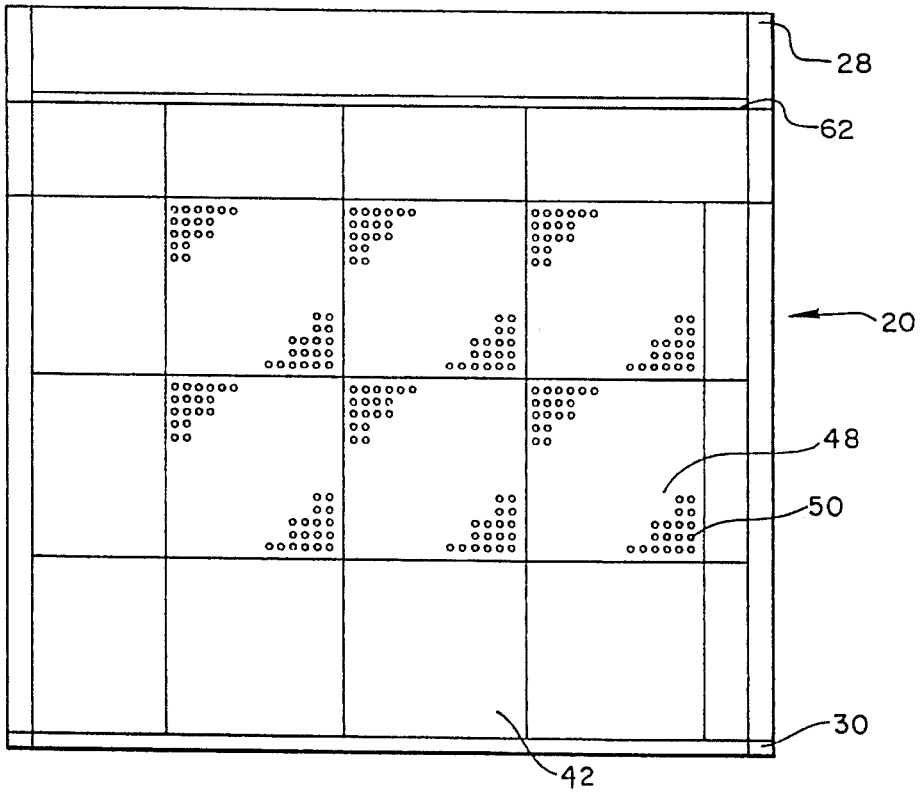
FIG. 6 is an elevational view of the inner surface of the rear wall of the acoustic performance module.

Referring to FIGS. 4–6, each of the inner surfaces 32 of each of walls 14, 16, 18, 20 includes a plurality of sound absorption panels 50 protected by inner liners 48 mounted on one or more modular panels 42. The absorption panels 50 are made of material with anechoic characteristics, such as, for example, absorption panels of the model no. 2540000 series manufactured by Wenger Corporation of Owatonna, Minn.

The floor 22 is generally horizontal and extends along and between the lower wall margins 30 of the walls 14, 16, 18, 20. The floor is of sufficient size to accommodate several chairs or individuals. The floor 22 may be constructed of various nonporous materials. In the preferred embodiment, the floor 22 is constructed of wood.

Figure 7:
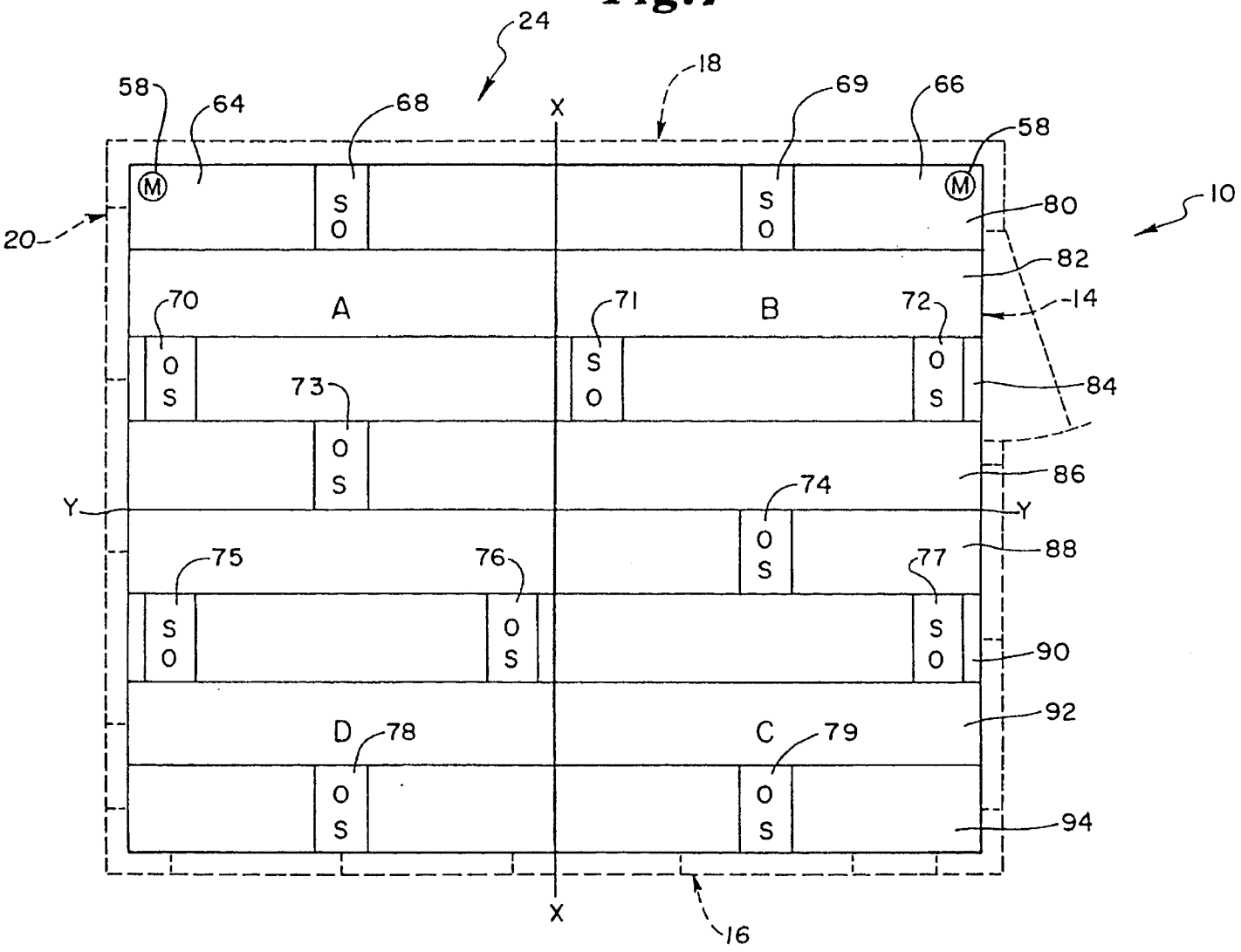
FIG. 7 is a bottom plan view of the inside top wall (the ceiling) of the acoustic performance module.
Figure 9:
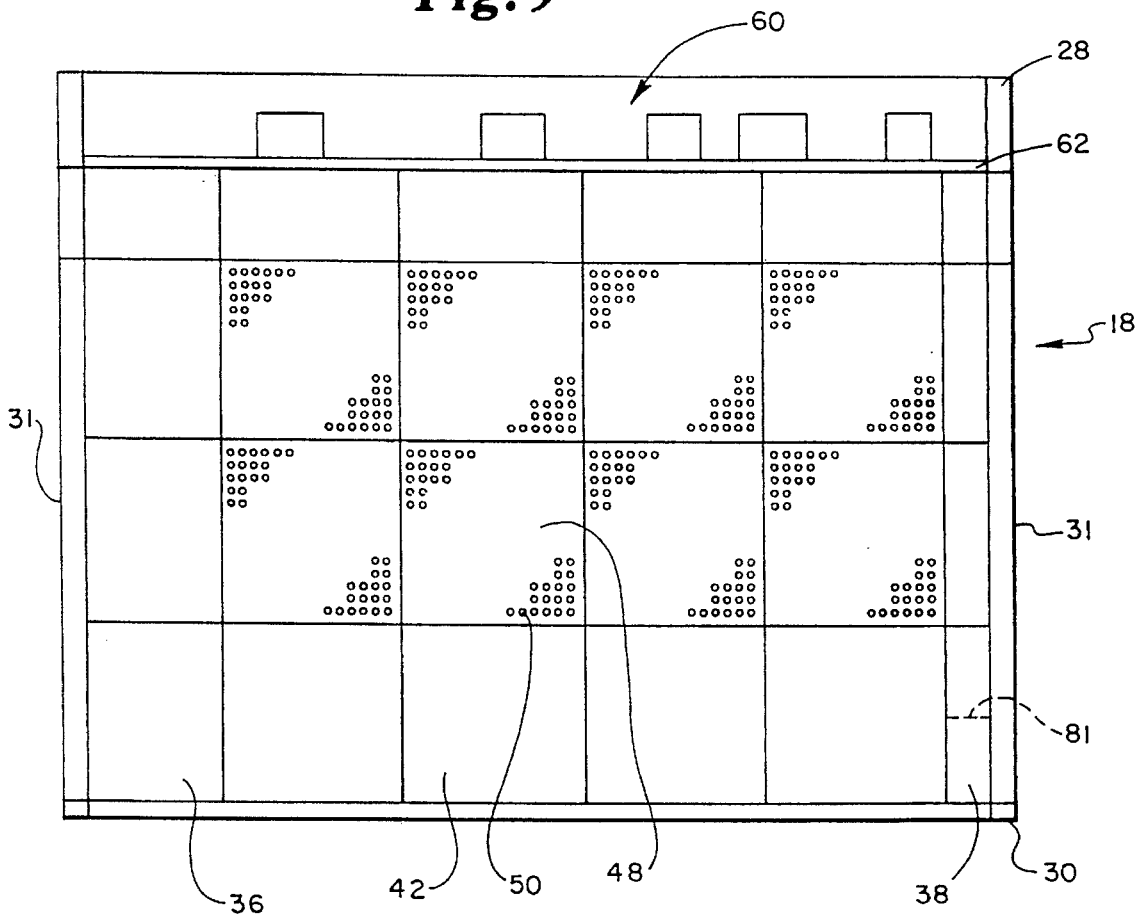
FIG. 9 is an elevational view of the inner surface of side walls of the acoustic performance module in accordance with an alternate embodiment.
Figure 10:
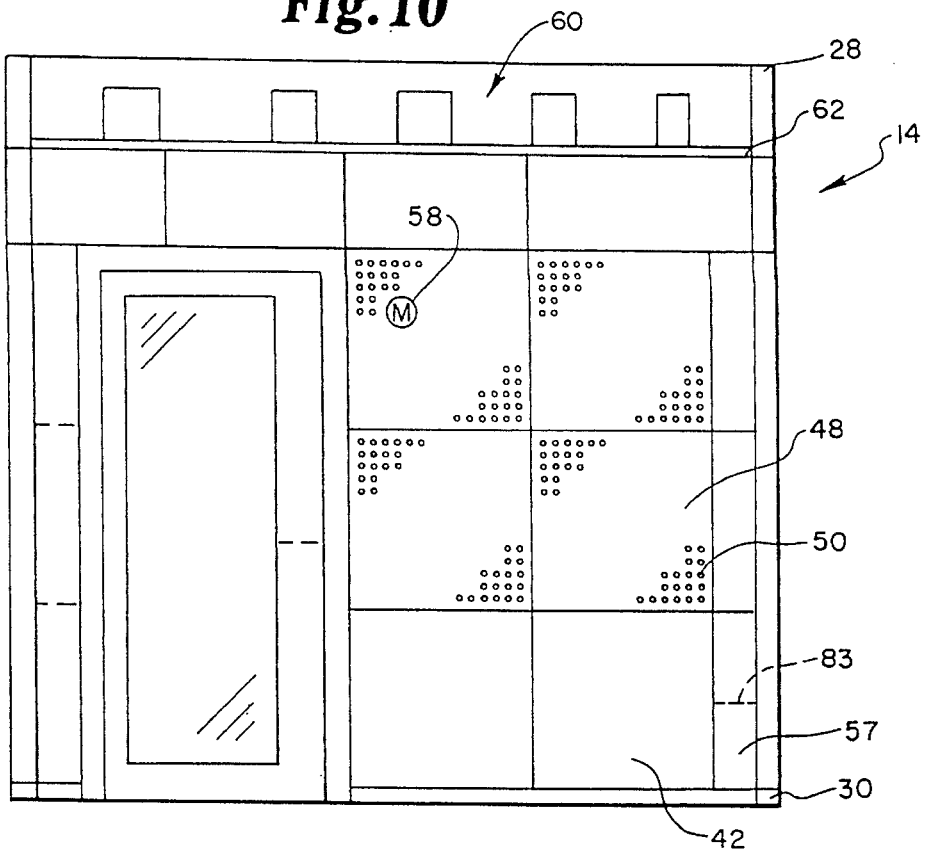
FIG. 10 is an elevational view of inner surface of front wall of the acoustic performance module in accordance with an alternate embodiment.
Figure 11:
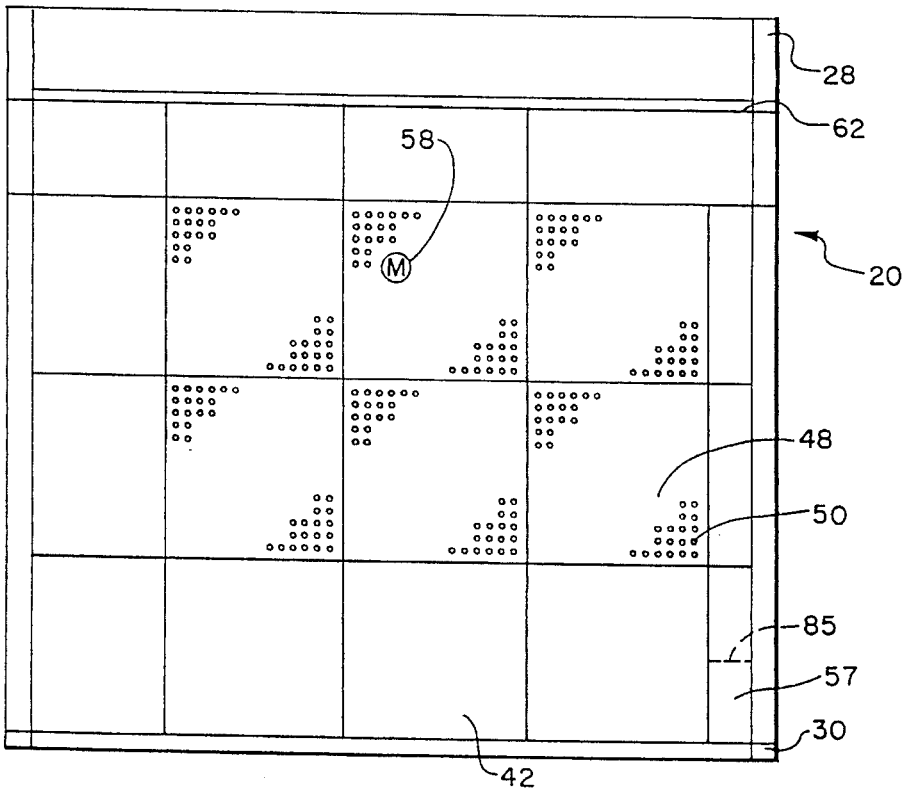
FIG. 11 is an elevational view of the inner surface of the rear wall of the acoustic performance module in accordance with an alternate embodiment.

Referring to FIG. 7, the ceiling 24 extends along and between the upper wall margins 28 of the walls 14, 16, 18, 20 (shown in shadow). In the preferred embodiment, the ceiling 24 broadly includes a plurality of microphones 58, a speaker array 60, an inner ceiling 62, an outer shield 63 a right inner corner 64 and left inner corner 66. Referring to FIGS. 9–11, in an alternate embodiment, at least a portion of the speaker array 60 is positioned in one or more walls 14, 16, 18, 20 and one or more microphones 58 are positioned in one or more walls 14, 20.

The microphones 58 are mounted against the ceiling 24 an equidistance from the center of the performing space 12 and are positioned relative to a predetermined pattern of the speaker array 60. In the preferred embodiment, the microphones 58 are adjacent to the right inner corner 64 and left inner corner 66 of the ceiling 24. Referring to FIGS. 10 and 11, in an alternate embodiment, each of the microphones 58 are positioned in opposed walls 14, 18 at least 5 feet from the lower wall margin 30 and equidistant from opposed side margins 31. More specifically, each microphone 58 is mounted 72" from the lower wall margin 30. In the alternate embodiment, the microphones 58 are at least 3 feet from any one of the speakers in the speaker array 60. Each of the microphones 58 are directed into the performance space 12 and positioned at least eighteen inches from any possible source of sound within the performing space 12. In the alternate embodiment, each of the microphones are directed to the floor 22. The microphones are of a flat frequency response type with low self noise, such as, for example, SM102 series microphones of SHURE.

The speaker array 60 includes a plurality of speakers 68, 69, 70, 71, 72, 73, 74, 75, 76, 77, 78, 79 mounted against the ceiling 24 in a predetermined pattern and aligned with each other speaker 68, 69, 70, 71, 72, 73, 74, 75, 76, 77, 78, 79 along the same medial plane. In an alternate embodiment, the speaker array 60 includes a plurality of speakers 68, 69, 70, 71, 72, 73, 74, 75, 76, 77, 78, 79, 81, 83, 85, 87 for a total of sixteen speakers in speaker array 60. Speakers 68, 69, 70, 71, 72,73, 74, 75, 76, 77, 78, 79 are mounted against the ceiling 24 in a predetermined pattern and aligned with each other speaker 68, 69, 70, 71, 72, 73, 74, 75, 76, 77, 78, 79 along the same medial plane.

Referring to FIGS. 9–11, in an alternate embodiment, speakers 81, 83, 85, 87 are mounted adjacent to the lower wall margins 30 of the walls 14, 16, 18, 20. More specifically, each of the speakers 81, 83, 85, 87 are recessed into a wall 14 at the corners of the room, i.e. adjacent to lower wall margins 30 and side margins 31 of two adjacent walls 14, 16, 18, 20.

The speakers 68, 69, 70, 71, 72, 73, 74, 75, 76, 77, 78, 79, 81, 83, 85, 87 may possess similar or different properties. In the preferred embodiment, the speakers 68, 69, 70, 71, 72, 73, 74, 75, 76, 77, 78, 79, 81, 83, 85, 87 are of similar make and construction and provide performance levels of ±2 dB from 70 Hz-20 kHz (on axis 0° ) and ±2 dB from 70 Hz-15 kHz (off axis 30° ). Each of the speakers includes a transformer 81 operably attached to the speaker 68, 69, 70, 71, 72, 73, 74, 75, 76, 77, 78, 79, 81, 83, 85, 87.

The speaker array 60 pattern is predetermined to provide even sound coverage of the performance space 12 and reduce sound distortions occurring when the ear distinguishes the sounds of one speaker 68 from those of another 69. Those skilled in the art will recognize that other speaker arrays 60 are possible.

In the preferred embodiment, the speaker array 60 includes three speakers positioned in each of four zones A, B, C, D. For purposes of discussion, the ceiling 24 is divided into eight generally parallel channels 80, 82, 84, 86, 88, 90, 92, 94 and four zones. The zones are labeled A, B, C and D beginning in the left inner corner 66 and moving clockwise around the ceiling 24. Each channel 80 extends between side walls 16, 18.

The speaker positions in zones A and C are mirror images of each other along vertical plane along line X—X and the speaker positions in zones B and D are mirror images of each other along line Y—Y.

More specifically, in the preferred embodiment, in zone A, speakers 68, 73 are placed equidistant from side wall 20 and vertical plane X—X in channels 80, 86 and speaker 70 is positioned adjacent to side wall 20 in channel 84. In zone B, a speaker 69 is placed equidistant from side wall 14 and vertical plane X—X in channel 80. In channel 84 in zone B speakers 71, 72 are placed adjacent to side wall 14 and adjacent to vertical plane X—X. In zone C, speakers 74, 79 are placed equidistant from side wall 14 and vertical plane X—X in channels 88, 94. Speaker 77 is placed adjacent to side wall 14 in channel 90. In zone D, speaker 78 is placed equidistant from side wall 20 and vertical plane X—X in channel 94. In channel 90 in zone D speakers 75, 76 are placed adjacent to side wall 20 and adjacent to vertical plane X—X.

In addition, each of the speakers 68, 69, 70, 71, 72, 73, 74, 75, 76, 77, 78, 79 are positioned such that each speaker is connected to the electroacoustic system 26 via a different channel than adjacent speakers. For example, referring to FIG. 7, speakers 68, 72, 76 are connected to the electroacoustic system 26 through the same channel; speakers 69, 73, 77 are connected to the electroacoustic system 26 through the same channel but a different channel than that which connects speakers 68, 72, 76 to the electroacoustic system 26. Speakers 70, 74, 78 are connected to the electroacoustic system 26 through a third channel and speakers 71, 75, 79 are connected to the electroacoustic system 26 through a fourth channel. In the alternate embodiments, each of the four speakers 81, 83, 85, 87 is connected to the electroacoustic system 26 through a different channel than the other speakers 81, 83, 85, 87.

The inner ceiling 62 extends along and between the walls 14, 16, 18, 20 adjacent to the speakers 68. The inner ceiling is formed of perforated metal. The outer shield 63 is secured to the ceiling 24 and extends downwardly along at least a portion of the walls 14, 16, 18, 20.

The walls 14, 16, 18, 20, floor 22 and ceiling 24 are secured together to form a rigid box-like structure. It is understood that the width and length of the performing space 12 defined by the walls 14, 16, 18, 20, floor 22 and ceiling 24 may vary according to whether the rehearsal room is designed to accommodate individual performers, an ensemble or larger performing groups such as a band. It will be understood that an increase in the length and width of the performing space 12 will require a corresponding increase in the number of speakers in the speaker array 60.

Figure 8:
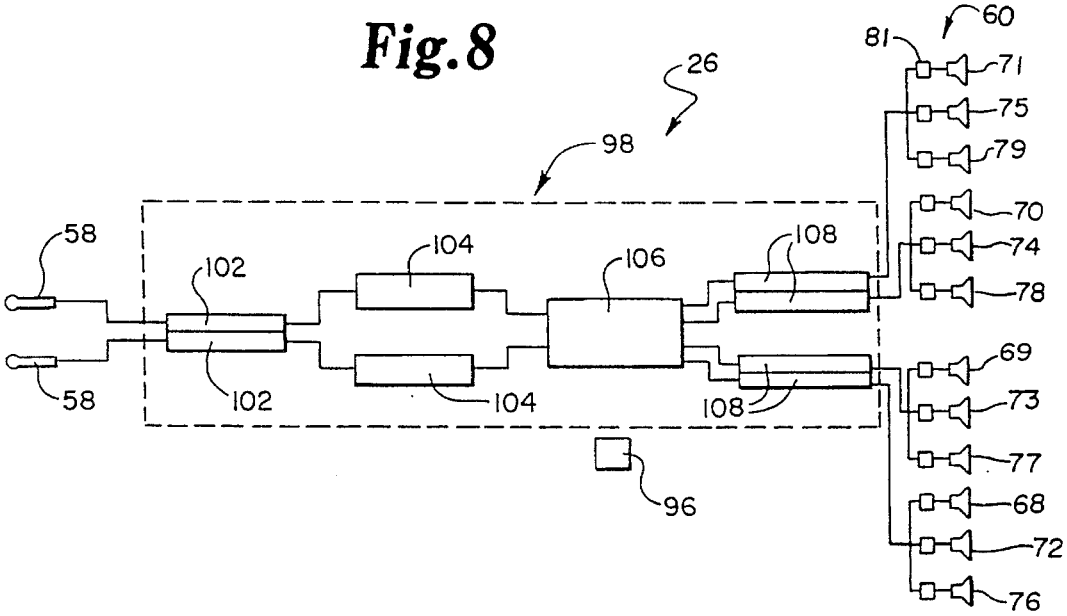
FIG. 8 is a schematic diagram of the electroacoustic system in accordance with the present invention.

Referring to FIGS. 3 and 8, the electroacoustic system 26 broadly includes remote user input device 96 and computer-based acoustical control system 98. The remote user input device 96 is mounted within the performance space 12 and operably connected to the acoustical control system 98. It will be understood that the user input device 96 may be, for example, a computer keyboard and monitor, a series of dials, buttons, levers or a computer touchscreen. In an alternate embodiment, the user input device 96 may be a MIDI control device, such as, for example, MRC panel by Lexicon of Waltham, Mass., which is connected to the acoustical control system 98 through a port connection 100 in the floor 22 (shown in FIG. 3).

As shown in FIG. 8, the acoustical control system 98 is operably attached to the microphones 58 and speaker array 60 but located at a location remote from the performing space 12. The acoustical control system 98 includes a plurality of microphone pre-amplifiers 102, a plurality of twenty eight band graphic equalizers 104, a digital sound processor 106 and a plurality of amplifiers 108. The microphone pre-amplifiers 102 are preferably operated with a low signal to noise ratio and are transformer coupled, such as Model MP-2 manufactured by Gaines Audio. The equalizers 104 perform within ±2 dB signal to noise ratio with balanced input and outputs, such as, for example, Model MPE28 manufactured by Rane Corporation of Mukilteo, Washington. The sound processor 106 is a system, such as the LARES system sold by Lexicon of Waltham, Mass., which is capable of providing time-variant synthetic reverberation of sound with at least 4 channels output and controlled via RS-422 remote selection or MIDI. The amplifiers 108 preferably have a low signal to noise ratio with a minimum of 50 watts per channel at 8 ohms. Those skilled in the art will recognize that the acoustical control system 98 may include sound recording equipment for permanent storage of performances.

In operation, a performer 110 enters the performance space 12 and selects the type of acoustical environment desired by entering user selected data into the user input device 96. It is understood that the performer may be an individual or a group of persons. The performer 110 then begins to produce sound, such as, for example, by speaking or playing a musical instrument. The sound waves produced move out from the performer into the performance space 12. As the sound waves contact the sound absorption panels 50, the sound is absorbed and little or no reverberation is produced. The placement of the sound absorption panels 50 along the walls 14, 16, 18, 20 of the performance space 12 produces a semi-anechoic environment.

As the sound waves travel toward the ceiling 24, walls 14, 16, 18, 20 and floor 22 the sound is captured by the microphones 58, channeled through the electroacoustic system 26 and then broadcast to the performer 110 through speaker array 60.

As those skilled in the art understand, in the alternate embodiment, placement of the microphones 58 in opposed walls 14, 20 offers a logarithmic gain in sound with the increased distance from the speakers 68, 69, 70, 71, 72, 73, 74, 75, 76, 77, 78, 79, 81, 83, 85, 87. Thus, the captured sound can be broadcast back to the performer at higher decibel levels such that the room sounds louder. Greater control of the volume of the sound maximizes the ability to mimic smaller, more intimate performance halls with greater accuracy.

The predetermined pattern of the speaker array 60 and the placement of the speakers 68, 69, 70, 71, 72, 73, 74, 75, 76, 77, 78, 79 in the same medial plane well above the head of the performer 110 minimizes the ability of the performer's ears to distinguish the exact origin of the sound. In an alternate embodiment of the predetermined pattern of the speaker array 60, the placement of the speakers 68, 69, 70, 71, 72, 73, 74, 75, 76, 77, 78, 79, 81, 83, 85, 87 in both the walls 14, 16, 18, 20 and against the ceiling 24 enhances the sound of the room by surrounding the performer more completely with sound. To the performer's ear, the alternate embodiment minimizes the decay of sound travelling from the speakers 68, 69, 70, 71, 72, 73, 74, 75, 76, 77, 78, 79 mounted against the ceiling by providing sound from speakers 81, 83, 85, 87. The broadcast sound blends clearly. The alternate embodiment minimizes the problem of having all the sound originate from above the performer as if the performer was performing in a well. The speaker array 60 provides even sound coverage of the room regardless of the exact position of the performer within the performing space 12.

In order to provide a variety of acoustical environments, the electroacoustic system 26 alters the sound wave to simulate the direction of reverberations, sound intensity and time lag of reverberations that would be produced if the sound wave was echoing in a large concert hall or auditorium. The sound absorption panels 50 help simulate the anechoic nature of large performance halls provided by the audience space. Because of the placement and arrangement of the speaker array 60, the auralization effect simulates the acoustical environment of a large performance hall though the performer 110 is actually in a small enclosed rehearsal room. The performer 110 hears the performance as it would sound in the large performance hall.

It will be understood that by changing the simulated sound, parts of the room may give the auralization effect of performing on a more enclosed stage in a large performance hall while the remainder of the room may simulate the unencumbered audience portion of the performance hall.

The inner ceiling 62 secures the speakers 68, 69, 70, 71, 72, 73, 74, 75, 76, 77, 78, 79 from theft and provides a uniform visual surface. The outer shield 63 provides additional protection to the electroacoustic system and enhances the sound isolation of the room from external noises. In an alternate embodiment, panels 57 protect speakers 81, 83, 85, 87 from theft while permitting sound to broadcast from the speakers 81, 83, 85, 87. Location of the acoustical system 98 in a secure location from the performing space 12 allows for increased security of the equipment and operation of the rehearsal room with a rehearsal room operation in attendance.

Numerous characteristics and advantages of the invention have been set forth in the foregoing description. It will be understood, of course, that this disclosure is, in many respects, only illustrative. Changes can be made in details, particularly in the matters of shape, size and arrangement of parts without exceeding the scope of the invention. The invention scope is defined by the language by which the appended claims are expressed.

What is claimed is:

1. An acoustic virtual environment room comprising:

a performance space having a plurality of walls, a floor and a ceiling, each of said walls presenting an inner surface, an outer surface, a wall lower margin and a wall upper margin, said walls including a plurality of acoustical absorption panels at said inner surface;

a plurality of microphones operably coupled to said ceiling at predetermined locations;

a plurality of acoustical speakers operably coupled to said ceiling at predetermined locations relative to the position of said microphones; and an electroacoustic system comprising a remote user input device and an acoustic control system, said electroacoustic system being operably coupled to said microphones and said speakers whereby sound performances in said performance space are enhanced to acoustically simulate a physical environment selected from a plurality of physical environments with different acoustical characteristics.

2. The acoustic virtual environment room of claim 1, said acoustical speakers uniformly aligned along a horizontal plane.

3. The acoustic virtual environment room of claim 1 wherein said plurality of speakers is twelve speakers.

4. The acoustic virtual environment room of claim 1 wherein said ceiling is divided into four distinct ceiling zones and said speakers are positioned three to each ceiling zone.

5. The acoustic virtual environment room of claim 1 wherein said electroacoustic system includes a plurality of sound channels, each of said speakers coupled to one of said sound channels distinct from said channels to which adjacent speakers are coupled.

6. The acoustic virtual environment room of claim 1 wherein said ceiling and said walls present a plurality of corners within said acoustic virtual environment room, one of said predetermined locations of said microphones is adjacent to one of said corners and a second of said predetermined locations of said microphones is adjacent to a second of said corners where said second corner and said first corner are along opposite ends of one of said walls.

7. The acoustic virtual environment room of claim 1, said plurality Of acoustical speakers including, at least, three speakers, where a portion of said acoustical speakers operably coupled to said ceiling uniformly aligned along a horizontal plane and another portion of said acoustical speakers operably coupled to said walls adjacent to said lower margin of said wall and a third portion of said plurality of acoustical speakers operably coupled to a second said walls.

8. The acoustic virtual environment room of claim 7 wherein said plurality of speakers is sixteen speakers.

9. The acoustic virtual environment room of claim 8 wherein said ceiling is divided into four distinct ceiling zones and said speakers operably coupled to said ceiling are positioned three to each ceiling zone.

10. The acoustic virtual environment room of claim 9 wherein said electroacoustic system includes a plurality of sound channels, each of said speakers coupled to one of said sound channels distinct from said channels to which adjacent speakers are coupled.

11. The acoustic virtual environment room of claim 1 wherein one of said walls presenting opposed side margins, one of said predetermined locations of said microphones is on said wall equidistant from said opposed side margins of said wall.

12. The acoustic virtual environment room of claim 11 wherein one of said predetermined locations of said microphones is 72" from said wall lower margin.

13. The acoustic virtual environment room of claim 1 wherein one of said microphones is secured to a first of said walls and a second of said microphones is secured to a second of said walls opposed to said first wall.

14. The acoustic virtual environment room of claim 1 wherein each of said microphones is at least three feet from any of said acoustic speakers.

15. The acoustic virtual environment room of claim 1 wherein said acoustic control system comprises a computer processor, a plurality of microphone preamplifiers, a plurality of graphic equalizers, a digital sound processor and a plurality of amplifiers.

16. An acoustic virtual environment rehearsal room adapted for a performer to rehearse aural performances in a synthetic aural environment selected from one of a plurality of different synthetic aural environments simulating the aural characteristics of preselected different physical environments, comprising:

a performance space defined by a plurality of walls, a floor, and a ceiling;

acoustical absorption material oriented within said performance space so that said performance space has a semi-anechoic aural performance characteristic;

at least one microphone positioned within said performance space to receive sound energy generated by said performer;

an electroacoustic system operably coupled to said microphone, said electroacoustic system adapted for providing processed variant representations of said sound energy generated by said performer on at least two sound channels; and a plurality of acoustical speakers operably coupled to said electroacoustic system, with said at least two sound channels each having at least one speaker operably coupled therewith, said speakers being positioned within said performance space to rebroadcast said sound energy generated by said performer and processed by said electroacoustic system within said performance space, whereby said performer hears the sound generated by the performer within the performance space as if it were generated in one of said preselected physical environments.

17. The acoustic virtual environment rehearsal room of claim 16 in which each of said acoustical speakers are coupled to one of said at least two sound channels distinct from said channels to which adjacent speakers are coupled.

18. The acoustic virtual environment rehearsal room of claim 16 in which the processed variant representations of said sound energy comprise time variant synthetic reverberations of said sound energy.

19. A method of creating an acoustic virtual environment rehearsal room adapted for a performer to rehearse aural performances in a synthetic aural environment selected from one of a plurality of different synthetic aural environments simulating the aural characteristics of preselected different physical environments, comprising the steps of:

providing a performance space defined by a plurality of walls, a floor, and a ceiling;

orienting acoustical absorption material within said performance space so that said performance space has a semi-anechoic aural performance characteristic;

positioning at least one microphone within said performance space to receive sound energy generated by said performer;

operably coupling an electroacoustic system to said microphone, said electroacoustic system adapted for providing processed representations of said sound energy generated by said performer on at least two sound channels; and operably coupling a plurality of acoustical speakers to said electroacoustic system, with said at least two sound channels each having at least one speaker operably coupled therewith, said speakers being positioned within said performance space to rebroadcast said sound energy generated by said performer and processed by said electroacoustic system within said performance space, so that said performer hears the sound generated by the performer within the performance space as if it were generated in one of said preselected physical environments.

20. The method of claim 19 in which the step of operable coupling an electroacoustic system to said microphone comprises the step of providing preselected time-variant synthetic reverberation of said sound energy.

21. The method of claim 19 in which the step of operably coupling a plurality of acoustical speakers to said electroacoustic system comprises the step of coupling each of said acoustical speakers to one of said at least two sound channels distinct from said channels to which adjacent speakers are coupled.

* * * * *

UNITED STATES PATENT AND TRADEMARK OFFICE

CERTIFICATE OF CORRECTION

PATENT NO. : 5,525,765

DATED : June 11, 1996

INVENTOR(S) : Freiheit

It is certified that error appears in the above-identified patent and that said Letters Patent is hereby corrected as shown below:

Column 2, line 34, delete "with the ceiling removed for clarity".

Column 2, line 36, after the word "module", insert "with the ceiling removed for clarity".

Column 3, line 39, insert a comma after the number "63".

Column 4, lines 22-23, delete the space between "Hz-20" and "kHz" , and delete the space between "Hz-15" and kHz".

Column 7, line 58, the word "Of" should be lowercase.

Signed and Sealed this

First Day of October, 1996

*Attest:*

Bruce Lehman

BRUCE LEHMAN

*Attesting Officer*

*Commissioner of Patents and Trademarks*